US005259458A

United States Patent [19]

Schaefer, Jr. et al.

[11] Patent Number: 5,259,458

[45] Date of Patent: Nov. 9, 1993

[54] SUBSEA SHELTER AND SYSTEM FOR INSTALLATION

[76] Inventors: Louis E. Schaefer, Jr., 313 Wright Ave., Gretna, La. 70056; David G. Ross, 101 Custom Queens Rd., Victoria, Tex. 77901

[21] Appl. No.: 762,581

[22] Filed: Sep. 19, 1991

[51] Int. Cl.[5] ..... E21B 33/037; E02D 5/32; E02D 7/24

[52] U.S. Cl. ..... 166/335; 166/356; 166/223; 175/213; 405/226

[58] Field of Search ..... 166/335, 338-342, 166/344, 345, 349-353, 356, 360, 368; 175/7, 213; 405/211, 226

[56] References Cited

U.S. PATENT DOCUMENTS

| | | | |
|---|---|---|---|
| 1,721,805 | 7/1929 | Cormier . | |
| 3,063,500 | 11/1962 | Logan . | |
| 3,247,672 | 4/1966 | Johnson | 166/351 X |
| 3,516,489 | 6/1970 | Jergins . | |
| 3,543,846 | 12/1970 | Smith | 166/267 X |
| 4,220,421 | 9/1980 | Thorne | 405/211 |
| 4,273,472 | 6/1981 | Piazza et al. | 166/356 X |
| 4,279,545 | 7/1981 | de Werk | 405/211 |
| 4,323,118 | 4/1982 | Bergmann | 166/356 X |
| 4,452,312 | 6/1984 | Roblin | 166/339 |
| 4,519,727 | 5/1985 | Mitchell et al. | 405/211 X |
| 4,558,744 | 12/1985 | Gibb | 166/356 X |
| 4,919,210 | 4/1990 | Schaefer | 166/356 |

FOREIGN PATENT DOCUMENTS

| | | | |
|---|---|---|---|
| 2015062 | 8/1979 | United Kingdom | 405/211 |
| 2226352 | 6/1990 | United Kingdom | 405/211 |
| 2234002 | 1/1991 | United Kingdom | 405/211 |

*Primary Examiner*—Ramon S. Britts
*Assistant Examiner*—Roger J. Schoeppel
*Attorney, Agent, or Firm*—Pravel, Hewitt, Kimball & Krieger

[57] ABSTRACT

A subsea abandoned wellhead protection system which may be installed underwater without the need for underwater assistance from divers or the like, the system allowing full site preparation and installation from the surface. The present invention teaches a new and unique system for the lowering and centering of the shelter over the wellhead, as well as a new system for the preparation of the installation site, including the removal of debris from the site and excavation of the ground surface area about the abandoned wellhead via a remote, fluid actuated, integrated excavation system. The present invention, with the utilization of a somewhat frustoconically or pyramidally configured shelter structure, uses a conduit system from the top of the structure to the base, terminating in a plurality of excavation jets about the periphery of the base area, providing a fluid stream of adjustable intensity (depending upon the excavation surface) for "trenching" the installation area, thereby allowing the base of the structure to sit below the ground surface. The present invention provides a new, innovative, and less expensive system for the installation of abandoned wellhead shelters and the like in an underwater environment.

8 Claims, 4 Drawing Sheets

SUBSEA SHELTER AND SYSTEM FOR INSTALLATION

BACKGROUND of INVENTION

1. Field of Invention

The present invention relates to subsea shelters for abandoned wellheads and the like and more particularly to a system which may be installed underwater without the need for underwater assistance from divers or the like, the system allowing full installation from the surface, utilizing conventional oilfield tools and equipment.

The present invention teaches a new and unique system for lowering and centering the shelter over the wellhead, as well as a new system for the preparation of the installation site, including the removal of debris from the site and excavation of the ground surface area about the abandoned wellhead via a remote, fluid actuated excavation system.

The present invention, with the utilization of a somewhat pyramidally or frustoconically configured shelter structure, teaches a conduit system from the top of the structure to the base, terminating in a plurality of excavation jets about the periphery of the base area, providing a fluid stream of adjustable intensity (depending upon the excavation surface) for "trenching" the installation area, thereby allowing the base of the structure to sit below the over-all ground surface.

The present invention provides a new, innovative, and less expensive system for the installation of abandoned wellhead shelters and the like in an underwater environment.

2. Prior Art and General Background

While the prior art is replete with various designs for sheltering abandoned wellheads, valve stems, and the like, until now there has been no known system for installing these structures in a suitable manner without the necessity of a commercial diving team for preparing the installation site and supervising the installation and centering of the structure about the area to be sheltered.

The desirability in dispensing with the necessity of commercial divers in the present system is apparent when taking into account the extraordinary costs associated with retaining and utilizing a commercial dive team, and support team and platform. Plus, the utilization of divers requires additional time considerations, including an intolerance for less than optimal weather and/or sea conditions.

It is well known that the cost of supporting a typical commercial diver team and support in installing the typical abandoned wellhead shelter normally far exceeds the cost of providing the shelter itself. For example, the cost of a typical wellhead shelter may run $8,000.00–$10,000.00, while the dive team and support can easily run $10,000.00–$15,000.00 and higher, depending upon the job, depth and conditions.

Thus, not only could dispensing with the necessity of divers decrease the cost of providing abandoned wellhead shelters, also there is a time savings factor, with a major time and expense factor in the installation procedure being removed.

A list of prior patents which may be of interest is presented below:

| Patent No. | Patentee(s) | Issue Date |
|---|---|---|
| 4,919,210 | Shaefer | April 24, 1990 |

-continued

| Patent No. | Patentee(s) | Issue Date |
|---|---|---|
| 4,452,312 | Roblin | June 5, 1984 |
| 4,323,118 | Bergmann | Apr. 6, 1982 |
| 3,543,846 | Smith | Dec. 1, 1970 |
| 3,516,489 | Jergins | June 23, 1970 |
| 3,063,500 | Logan | Nov. 13, 1962 |
| 1,721,805 | Cormier | July 23, 1929 |

As may be discerned by a review of the above patents, the prior art does not teach a self-installable structural device or method for sheltering permanently or temporarily abandoned subsea wellheads, while being configured so as not to interfere with users of the seabed such as commercial fisherman and the like.

U.S. Pat. No. 3,063,500 issued 1962 and entitled "Underwater Christmas Tree Protector" teaches "an underwater housing or protector for protecting an underwater christmas tree".

This patent teaches a cylindrical shelter for underwater christmas trees for protecting the christmas tree from the corrosive effects of salt water. The shelter is in the form of a large diameter pipe driven into the sea floor, enveloping the christmas tree. In order to protect the christmas tree from corrosion, a protective oil fills the structure, thus providing a corrosion free environment for the christmas tree.

As may be further determined by a review of the patent, the structure is obviously distinguishable from the invention made the subject this application. The patent relates to a watertight, oil filled structure designed to envelope a christmas tree for corrosion prevention.

The structure as disclosed above is not suitable for the contemplated use as taught in the present invention. Further, the structure is not configured in such a manner as to protect the wellhead and commercial users of the sea bottom in accordance with the Federal Regulations; nor does the above invention teach an easily installed shelter, but rather a complicated, extensive scheme to prevent saltwater corrosion of underwater christmas trees.

Indeed, the configuration of the above structure invites the entanglement of trawls, nets, or the like which might pass over it. The main body of the structure is in the same cylindrical, vertical form as the naked wellhead, and thus provides little utility or opportunity for use under the federal guidelines discussed above. The elongated rods implemented in a horizontal sloping form above the shelter as disclosed in FIG. 4 would not prove effective in preventing nets, anchors, etc., from becoming entangled in the structure and would in fact invite entanglement.

U.S. Pat. No. 3,543,846 issued 1970 and entitled "Underwater Oil or Gas Facility" teaches a reinforced concrete underwater structure of a frustoconical configuration having the capability of serving as an underwater production, oil-gas separation facility, or storage facility.

The principal embodiment of the above patent teaches a rather large underwater structure, essentially serving as an underwater production platform. The exemplary embodiment appears to be the height of a 15 story building, and figures in the patent show personnel operating equipment therein.

Again, the present invention is obviously distinguishable from the above patent; the similarity of the general configuration of the two structures is the only pertinent trait. The patent does not teach an easily implemented, cost effective wellhead shelter and method of isolating the wellhead such that is does not pose a hinderance to navigation or commerce as disclosed in the present invention and is thus readily distinguishable.

Finally, U.S. Pat. No. 4,919,210 issued Apr. 24, 1990 to the present applicant entitled "Subsea Wellhead Protection System", teaches a system for the sheltering of submerged, permanently or temporarily abandoned wellheads or the like, utilizing a sloped structure configured to prevent nets, anchors, and the like from entangling or otherwise damaging the wellhead.

Like the other prior art, however, the '210 reference does not teach a self-installing system as contemplated in the present invention, as it requires the utilization of dive teams or the like for underwater support and preparation of the installation site.

Thus, based upon the above and foregoing, one can readily ascertain that the searched for invention has not been anticipated in the prior art.

GENERAL SUMMARY DISCUSSION OF THE INVENTION

All of the prior art known by applicant, set forth above, teaches shelter designs only, and not a system apparatus and method design providing for the self-installation of the shelter in an underwater environment without diver support.

The present invention teaches the prefabrication of a wellhead shelter generally frustoconical or pyramidal in configuration, with remote actuated excavation means incorporated therein, utilizing a pressurized fluid such as sea water or the like, as well as means for directing the pressurized fluid to the periphery of the base for clearing debris and providing an excavation of the ground area about the periphery of the installation area for lowering the shelter structure therein. The sea bed is excavated to a sufficient depth to allow the lower periphery, or "skirt", of the shelter to be below the mudline of the sea bed in order to avoid contact and possible overturning due to trawl cables and the like. Secondly, the depth of excavation allows a positive anchor joint of the net guard to the sea floor.

The present invention also contemplates the utilization of an installation procedure wherein sonar or like monitoring apparatus is utilized in the configuration for the positioning, placement and direction of the shelter to the installation site. The present invention, as contemplated, dispenses with the requirement of commercial divers and the like, decreasing the cost of providing the shelter, allowing it to be implemented under more circumstances after taking into account the economy of the new system.

It is an object of the present invention to provide a system for the installation of abandoned wellhead shelters and the like which dispenses with the need for a commercial dive team or other underwater supervision.

Further, it is an object of the present invention to provide an installation system for the installation of shelters for subsea wellheads and the like wherein site preparation and excavation can be accomplished at or from the surface.

It is another object of the present invention to provide a shelter for abandoned wellheads, valve stems, or the like which is flexible in nature relative to the shelter configuration.

Lastly, it is an object of the present invention to provide a subsea shelter and system for installing which is self centering and allows for remote site preparation and excavation without the need for special support equipment.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 1:
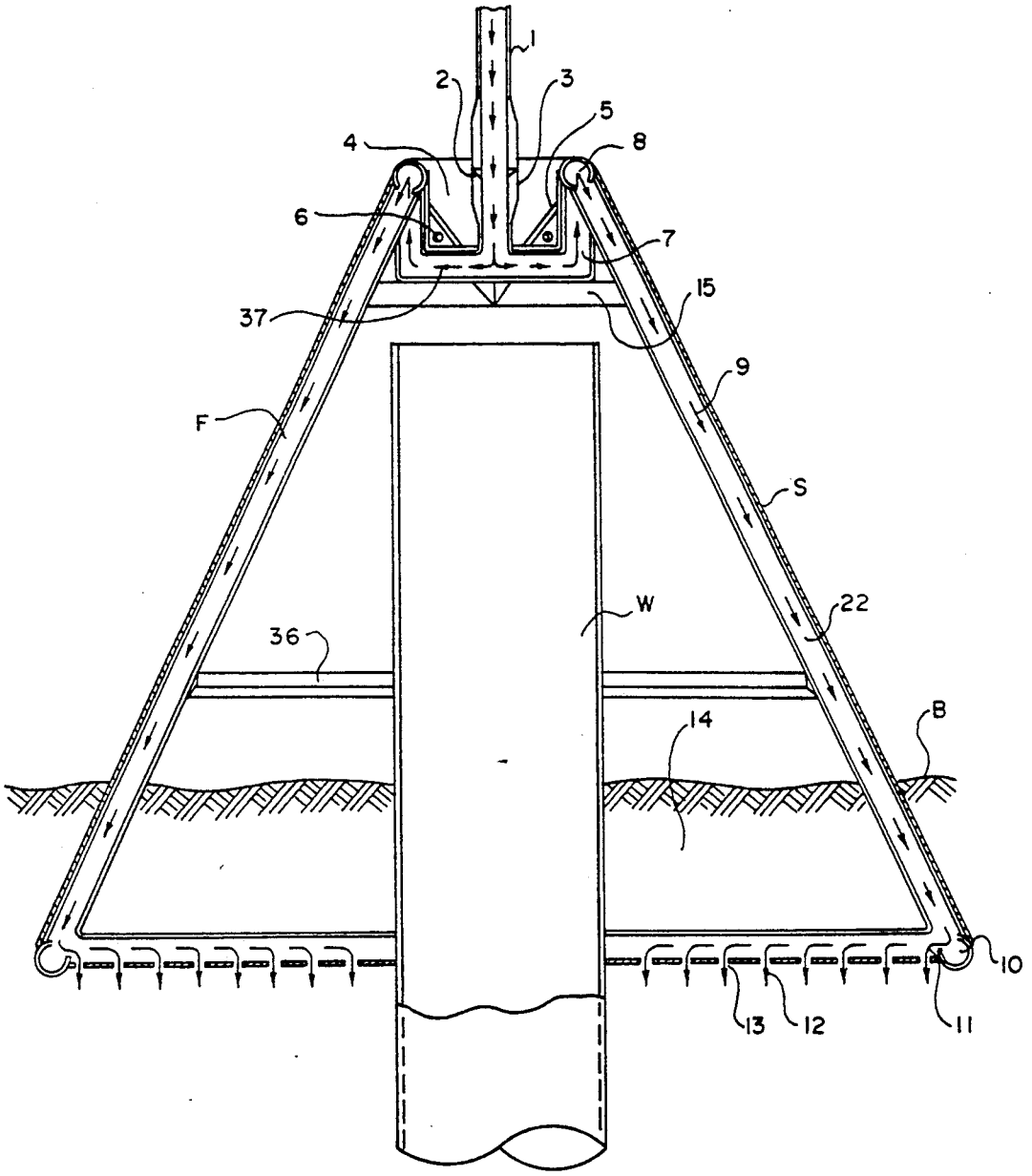
FIG. 1 is a side, cross-sectional view of the preferred, exemplary embodiment of the subsea shelter of the present invention, with the fluid flow being indicated by series of directional arrows.

As can be seen in FIG. 1, the preferred, exemplary embodiment of the present invention comprises a sloped shelter S, designed to envelope a subsea wellhead W, valve structure, pipe junction, or like arrangement, sitting on or partially under (14) the sea bed B, and is configured to prevent damage to the protected structure due to contact with nets, trawls and small craft which might otherwise have come into contact therewith.

The exemplary embodiment of the present invention comprises a structure wherein the side walls 16, 17 are configured primarily of one quarter (¼") inch mild "836" steel, and further includes a support frame of flow tubing having upper peripheral 8, edge 22, and lower peripheral 10, 11 portions, communicating in such a fashion as to allow fluid flow therethrough, coupled with supports 15, 36 to provide additional structural integrity.

Upper peripheral 8 flow tubing is configured to communicate with lateral flow tubing 7 and horizontal tubing 37, which in turn has affixed to it lateral tubing 3 having coupling 2, which allows interface to an exterior source of pressurized fluid.

Upper peripheral 8 flow tubing is configured with the upper area of the structure S to form a connection enclosure 4, wherein a coupling 2 is located for protection, as well as lifting tabs 5, 6 for lifting and positioning the present shelter in the installation thereof.

Lower peripheral flow tubing 10, 11 is configured with a plurality of nozzles 13 of, for example, one-eighth ($\frac{1}{8}$") to one quarter ($\frac{1}{4}$") inch diameter and are directed about the lower and side edges of the tubing.

The coupling 2 of the exemplary embodiment of the present invention is configured to communicate with drill pipe 1 or the like, the flow tubing system being configured to allow the unencumbered flow F of pressurized fluid 9 from the coupling 3 to the nozzles 13, and out of the nozzles, forming flow out 12.

Figure 2:
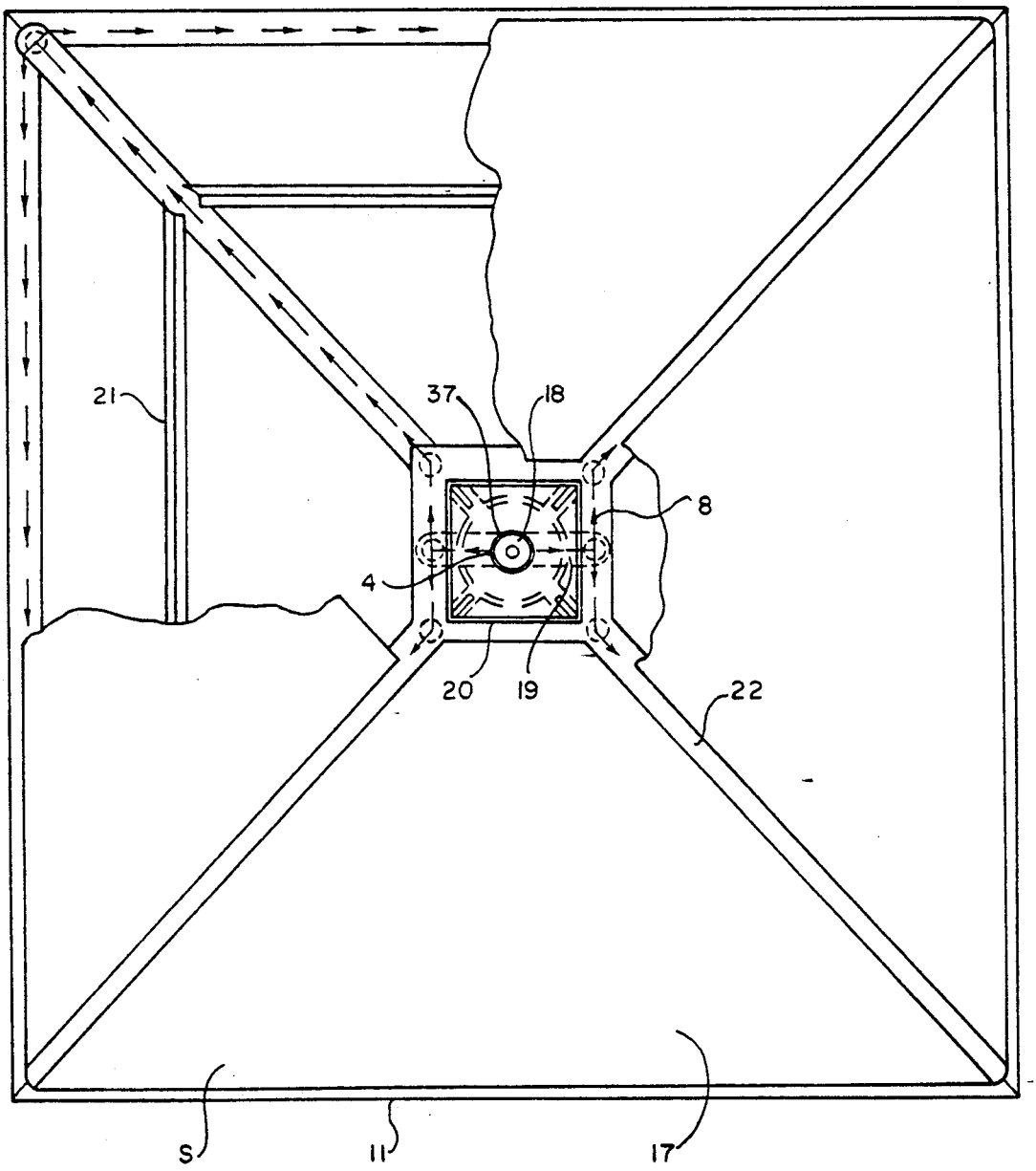
FIG. 2 is a top, partially cut-away view of the preferred embodiment of the subsea shelter of FIG. 1, with the fluid flow being indicated by series of directional arrows.

FIG. 2 illustrates the flow from the connection coupling 18, through the flow tubes 8, 11, 19, 22, and 37 and out the base, as well as the configuration of the upper protective connection enclosure 4.

Further illustrated is the configuration of shelter structure S, including side panel members 17 and supports 21, including the top 20 of the frame from a top view.

Figure 3:
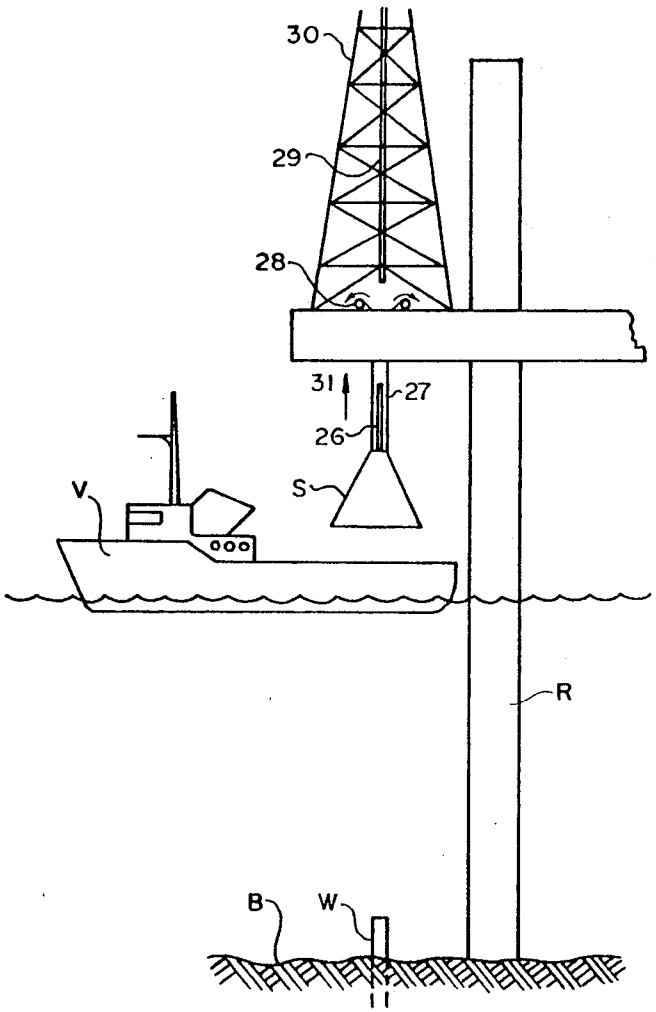
FIG. 3 is a side, generalized view of an offshore platform illustrating the installation procedure of the device of FIG. 1, and illustrating the cabled lifting of the subsea shelter for the installation system.

FIG. 3 illustrates the procedure whereby the present shelter S is installed over, for exemplary purposes, an abandoned wellhead W located on the sea floor B in approximately ninety feet of water, under a rig R, which includes a derrick 30 and pipe 29.

As further illustrated in FIG. 3, a vessel V, such as a crew boat or the like brings the shelter S under the rig R whereby installation is to take place, and cables 27 are attached to the shelter S. The shelter S includes a flow tube connection extender 26, which can be in the form of a length of drill pipe and which is affixed to the flow tube coupling or connection (illustrated as element 18 in FIG. 2), and the unit is then lifted 31 via winches 28 from the vessel V.

Figure 4:
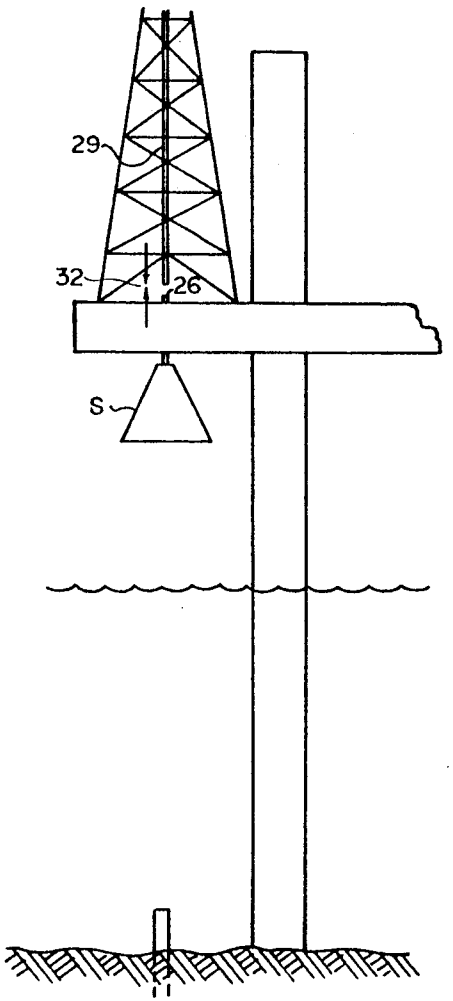
FIG. 4 is a side view of the installation procedure of the device of FIG. 3, illustrating the joining of the subsea shelter to the drill pipe of the rig.

As shown in FIG. 4 of the drawings, the shelter S is then positioned (note direction arrows 32) to engage with drill pipe section 29 via the extension coupling 26. In the preferred method, the pipe 29 is threadingly engaged to the extension coupling 26, and the pipe 29 may comprise, for example, standard configuration six inch (6") drill pipe or the like, thereby dispensing with the necessity of utilizing any specialized equipment for the installation.

Figure 5:
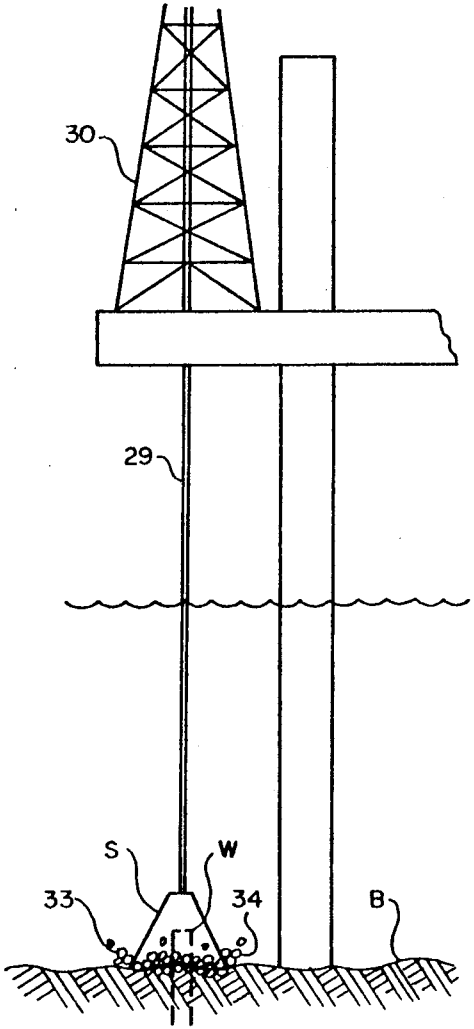
FIG. 5 is a side view of the installation procedure of the device of FIG. 3, illustrating the lowering of the subsea shelter to the sea floor and the partial excavation and clearing thereof via pressurized fluid communicated from the rig.

FIG. 5 illustrates the next step in the installation of the shelter S, wherein the shelter is lowered to the sea floor B and positioned over the structure, in this case an abandoned wellhead W via coordinating movements of the pipe 29 controlled by derrick 30. As the shelter S is lowered, additional sections of drill pipe are sequentially added as needed until the shelter's reaches the sea bed. During the lowering process, the drill pipe sections carry the load of the shelter S.

Once the shelter is positioned appropriately and rests upon the sea floor B, water or other fluid is pumped through pipe 29, through the flow tubes and exit nozzles of the structure S as illustrated by the fluid flow lines in FIGS. 1 and 2, an directed towards the sea floor B, causing and excavation 33 of the area 34 in the vicinity of the pressured spray emanating from the nozzles 13.

Figure 6:
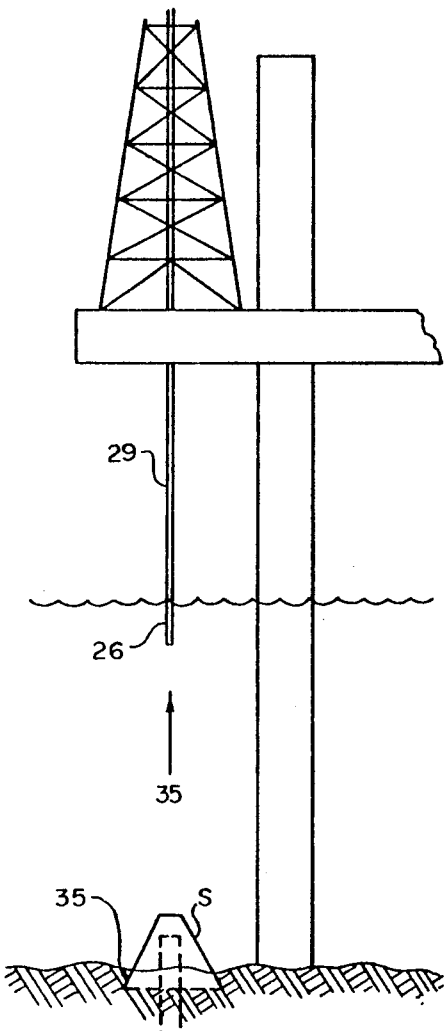
FIG. 6 is a side view of the installation procedure of the device of FIG. 3, illustrating the disconnecting and removal of the drill pipe from the subsea shelter, completing the installation process.

FIG. 6 illustrates the final step in the installation of the present system. As shown, the excavation jetting illustrated in FIG. 5 has caused the base of the shelter S to become partially buried (note 35) in the sea floor, stabilizing and anchoring it in position. The seabed is excavated to a sufficient depth to allow the lower periphery, or "skirt", of the shelter to be below the mud line of the sea bed in order to avoid overturning due to trawl cables and the like. Secondly, the depth of excavation allows a positive anchor joint of the net guard to the sea floor.

As further shown, pipe 29 and extension 26 are decoupled from shelter S and raised to the surface (note direction arrows 35), and the present installation is complete.

Exemplary specifications for the present invention are as follows, relative to the above exemplary installation:

| | |
|---|---|
| Depth | 90 Feet |
| Drill pipe diameter | 5 inches |
| Excavation fluid pressure | 200 PSI |
| Wellhead size | 30 inches |

Exemplary measurements of Shelter S:

| | |
|---|---|
| Length at Base | 11 feet 9 inches |
| Width at base | 11 feet 9 inches |
| Length at top | 32 inches |
| Width at top | 32 inches |
| Diameter of flow tubing | 4 inches |
| Type of steel | Mild carbine steel |
| Thickness of walls | $\frac{1}{4}$ inch |
| Type of steel | Mild carbine steel |

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. An apparatus for protecting an underwater structure on or near a seabed comprising:

a wellhead shelter, having a base, sidewalls and a top, said shelter comprising a structure of a size and configuration to envelope the underwater structure; and excavation means for removing a portion of the seabed surrounding the underwater structure, said excavation means comprising fluid jetting means situated about and permanently fixed with respect to the periphery of said base of said shelter for jetting out the seabed where the base is to rest.

2. The apparatus of claim 1, wherein said excavation means further comprises fluid delivery means, said fluid delivery means comprising fluid coupling means situated at said top of said shelter, running along said sidewalls, and about said periphery of said base of said shelter.

3. The apparatus of claim 2, wherein said fluid jetting means further comprises a plurality of fluid jetting orifices spaced about said periphery of said base of said shelter.

4. A method of installing an underwater apparatus at an installation site for sheltering an underwater structure on or near the seabed, comprising the following steps:

(a) providing a wellhead shelter having a base, sidewalls and a top, said shelter comprising a structure of a size and configuration to envelope the underwater structure, said shelter further comprising excavation means for removing a portion of the seabed, said excavation means comprising fluid jetting means situated about and permanently fixed with respect to the periphery of said base of said shelter, said excavation means further comprising fluid delivery means, said fluid delivery means comprising fluid coupling means situated at said top of said shelter, running along said sidewalls, and about said periphery of said base of said shelter, excavation means further comprising fluid jetting means, said fluid jetting means comprising a plurality of fluid jetting orifices spaced about said periphery of said base of said shelter;

(b) providing a vessel capable of transporting said shelter, lifting means capable of lifting said shelter, pumping means for conveying a pressurized fluid, and fluid conduit means for conveying said pressurized fluid from said pumping means to said fluid delivery means;

(c) transporting said shelter to said installation site via said vessel;

(d) attaching said fluid conduit means to said pumping means and to said fluid coupling means of said shelter;

(e) lifting said shelter from said vessel utilizing said lifting means;

(f) lowering said shelter to the vicinity of the installation site;

(g) initiating said pumping means, conveying pressurized fluid through said fluid conduit means to said fluid delivery means;

(h) jetting said pressurized fluid through said fluid jetting orifices about said periphery of said base of said shelter, thereby excavating a portion of said seabed about said periphery of said seabed about said base of said shelter until the base of said shelter is immersed into the seabed about the underwater structure.

(i) detaching said fluid conduit means from said fluid coupling means of said shelter; and (j) raising said fluid conduit means from said installation site.

5. A method of installing an underwater apparatus at an installation site, said underwater apparatus for sheltering a structure on or near the seabed, comprising the following steps:

(a) providing a wellhead shelter having a base, sidewalls and a top, said shelter comprising a structure of a size and configuration to envelope the underwater structure, said shelter further comprising excavation means for removing a portion of the seabed, said excavation means comprising fluid jetting means situated about the periphery of said base of said shelter, said excavation means further comprising fluid delivery means, said fluid delivery means comprising fluid coupling means situated at said top of said shelter, running along said sidewalls and about said periphery of said base of said shelter, said excavation means further comprising fluid jetting means, said fluid jetting means comprising a plurality of fluid jetting orifices spaced about and permanently fixed with respect to said periphery of said base of said shelter;

(b) providing a vessel capable of transporting said shelter, lifting means capable of lifting said shelter, pumping means for conveying a pressurized fluid, and a length of pipe for conveying said pressurized fluid from said pumping means to said fluid delivery means;

(c) transporting said shelter to said installation site via said vessel;

(d) affixing said length of pipe to said pumping means and to said fluid coupling means of said shelter;

(e) removing said shelter from said vessel;

(f) lowering said shelter to the vicinity of the installation site;

(g) initiating said pumping means, conveying pressurized fluid through said section of pipe to said fluid delivery means;

(h) jetting said pressurized fluid through said fluid jetting orifices about said periphery of said base of said shelter, thereby excavating a portion of said seabed about said periphery of said seabed about said base of said shelter;

(i) detaching said section of pipe from said fluid coupling means of said shelter; and (j) raising said section of pipe from said installation site.

6. The method of claim 5 wherein there is further included in connection with step "f" the step of:

sequentially attaching a series of drill pipe sections to said length of pipe and using said drill pipe sections to carry the load of said shelter as the shelter is lowered to the seabed.

7. The method of claim 5 wherein there is added after step (h) the following additional step:

continuing to excavate the seabed about the periphery of the shelter to a depth greater than the mud line.

8. The apparatus of claim 1, wherein the well head shelter has an open interior free of excavation means.

* * * * *